US009103329B2

(12) United States Patent
Corbett et al.

(10) Patent No.: US 9,103,329 B2
(45) Date of Patent: Aug. 11, 2015

(54) ELECTRIC PROPULSION

(75) Inventors: Michael Henry Corbett, Fleet (GB); Neil Charles Wallace, Sandown (GB)

(73) Assignee: QINETIQ LIMITED, London (GB)

( * ) Notice: Subject to any disclaimer, the term of this patent is extended or adjusted under 35 U.S.C. 154(b) by 1080 days.

(21) Appl. No.: 13/133,342

(22) PCT Filed: Dec. 17, 2009

(86) PCT No.: PCT/GB2009/002902

§ 371 (c)(1),
(2), (4) Date: Jul. 19, 2011

(87) PCT Pub. No.: WO2010/072995

PCT Pub. Date: Jul. 1, 2010

(65) Prior Publication Data

US 2011/0277445 A1 Nov. 17, 2011

(30) Foreign Application Priority Data

Dec. 23, 2008 (GB) ..... 0823391.8

(51) Int. Cl.
*F03H 1/00* (2006.01)

(52) U.S. Cl.
CPC ..... *F03H 1/0056* (2013.01); *F03H 1/0018* (2013.01); *F03H 1/0037* (2013.01); *F03H 1/0043* (2013.01); *F03H 1/00* (2013.01)

(58) Field of Classification Search
CPC ..... F03H 1/0081; F03H 1/0006; F03H 1/00; F03H 1/0012; F03H 1/0037; F03H 1/0043; F03H 1/005; F03H 1/0062; F03H 1/0068; F03H 1/0075; F03H 1/0087; F03H 1/0093; B64G 1/405; H01J 27/024
USPC ..... 60/200.1, 203.1, 202
See application file for complete search history.

(56) References Cited

U.S. PATENT DOCUMENTS

| | | | | |
|---|---|---|---|---|
| 3,279,175 | A | 10/1966 | Hendel et al. | |
| 5,241,244 | A * | 8/1993 | Cirri | 315/111.41 |
| 6,189,484 | B1 * | 2/2001 | Yin et al. | 118/723 I |
| 6,279,314 | B1 | 8/2001 | Valentian et al. | |
| 6,293,090 | B1 | 9/2001 | Olson | |
| 6,334,302 | B1 | 1/2002 | Chang-Diaz | |
| 7,183,716 | B2 * | 2/2007 | Kanarov et al. | 315/111.51 |
| 2007/0114903 | A1 * | 5/2007 | Tolmachev et al. | 313/231.31 |
| 2008/0271430 | A1 * | 11/2008 | Chabert | 60/202 |

FOREIGN PATENT DOCUMENTS

| | | | |
|---|---|---|---|
| DE | 102 34 902 | A1 | 2/2004 |
| WO | WO 2008/009938 | A1 | 1/2008 |

OTHER PUBLICATIONS

Popov "High Density Plasma Sources: Design, Physics and Performance" 1995 Noyes Publications, p. 59.*

(Continued)

*Primary Examiner* — Phutthiwat Wongwian
*Assistant Examiner* — William Breazeal
(74) *Attorney, Agent, or Firm* — Oliff PLC

(57) ABSTRACT

An electric propulsion system comprising a plasma chamber having first and second apertures for producing ion beams. Respective first and second coils are arranged about the chamber to produce an electromagnetic field in regions adjacent to the apertures, and are driven differentially by a radio frequency (RF) drive module. By driving the coils differentially, the electric field in the region of the two apertures can be differentially controlled, and a variation of output thrusts at the two apertures is possible. In this way a net thrust can be produced, which net thrust is varied by controlling the drive to the two coils.

12 Claims, 3 Drawing Sheets

(56) References Cited

OTHER PUBLICATIONS

Goebel, Dan M., "Analytical Discharge Model for RF Ion Thrusters," *IEEE Transaction on Plasma Science*, vol. 36, No. 5, pp. 2111-2121, Oct. 2008.

British Search Report issued in Application No. 0823391.8; Dated Apr. 7, 2009.

Written Opinion of the International Searching Authority issued in Application No. PCT/GB2009/002902; Dated Sep. 9, 2010.

International Search Report issued in Application No. PCT/GB2009/002902 Dated Sep. 9, 2010.

* cited by examiner

ELECTRIC PROPULSION

The invention relates to electric propulsion (EP) systems.

EP systems provide small amounts of thrust by high-speed ejection of accelerated ions from an ion engine, and find application in areas such as satellite and space-probe propulsion and satellite station-keeping. The ejected ions act as a propellant in the same way as the combustion products of a chemical rocket. Although the absolute amount of thrust produced by an EP system is very small compared to that of a chemical rocket, the very high velocity with which ions are ejected from the ion engine of an EP system means that the amount of thrust per unit mass flow rate is very large compared to that of a chemical rocket. For example, the Boeing® 702 EP system produces a thrust of 165 mN and has a mass flow rate of approximately 4.4 mg $s^{-1}$, corresponding to an approximate propellant ejection velocity of 37.5 km $s^{-1}$. In contrast, a main hydrogen/oxygen engine on a NASA space shuttle produces a thrust of the order of 2 MN and has a mass flow rate of approximately 700 kg $s^{-1}$, combustion products being expelled at velocity of 2.8 km $s^{-1}$.

Thrust range and resolution are important characteristics of EP systems. For example a field-effect EP (FEEP) system typically produces several μN of thrust and is capable of μN resolution. The maximum thrust level is however very limited unless multiple systems are employed in parallel. A gridded ion engine system (GIE), can produce a thrust of several tens of mN but thrust resolution is often limited to 10 μN. Furthermore it is usually not possible to reduce the thrust of a GIE below a certain minimum level. This is due to the fact that thrust control is achieved by control of the ion generation process—a relatively high power and inherently difficult process—and it is not possible to control and sustain ion generation to the extent that the thrust is zero.

In some applications it is advantageous for EP systems to produce thrusts on the order of mN with sub-μN resolution and which also have the ability to throttle down from mN thrust levels to zero. Applicant's co-pending application published as WO 2008/009938 proposes an electric propulsion system in which an acceleration and a screen grid are located at an ion output aperture, and whereby the potential between the two grids is varied to control the expulsion of ions, and hence thrust from a plasma chamber. In one embodiment two such ion apertures are arranged about a single plasma chamber to produce substantially anti-parallel thrusts, which can be varied substantially independently.

According to a first aspect of the present invention there is provided an electric propulsion system comprising a plasma chamber having first and second apertures for producing ion beams; a first coil arranged about the chamber and adapted to produce an electromagnetic field in a first region of the chamber adjacent to said first aperture; a second coil arranged about the chamber and adapted to produce an electromagnetic field in a second region of the chamber adjacent to said second aperture; and an RF drive module adapted to drive said first and second coils differentially.

By driving the coils differentially, the electric field in the region of the two apertures can be differentially controlled, and a variation of output thrusts at the two apertures is possible. In this way a net thrust can be produced, which net thrust is varied by controlling the drive to the two coils.

The first and second apertures in one embodiment are arranged to produce ion beams in directions which are substantially anti-parallel. In this way the net thrust remains along a fixed axis, and in certain arrangements its magnitude can be controlled by the differential driving of the two coils as described above.

More complex embodiments may include one or more additional apertures, and one or more corresponding coils arranged around the chamber and adapted to produce an electromagnetic field in a region of the chamber adjacent each such additional aperture. In such embodiments the RF drive module is adapted additionally to provide differential control to each additional coil. More commonly apertures and coils will exist in pairs, and differential control is provided between pairs of coils.

In certain embodiments the drive module is adapted to control the forward power and additionally or alternatively the loss to said first and second coils. Although the signal feed to each coil can be controlled independently, in embodiments of the invention it is not strictly true to consider that the coils are independently controlled due to coupling effects between them. For example a capacitance in a matching circuit for the drive path for a first coil could be adjusted to vary the loss to that coil, but coupling between the coils could result in some change also to the signal observed in the second coil. Nevertheless differential drive is achieved and the ion beams from the corresponding first and second apertures respond differently to the adjustment.

The difference in response of the ion beams to the control of the coils results from non-uniformity, or asymmetry of the plasma density in the plasma chamber.

According to a second aspect of the invention therefore, there is provided a method of operating an electric propulsion system comprising creating a discharge plasma in a plasma chamber; extracting at least two ion beams from said plasma chamber, each ion beam generating a thrust; and controlling an electromagnetic field in the chamber to produce an asymmetry in the plasma density, which asymmetry differentially varies the thrusts of said ion beams.

The electromagnetic field is advantageously controlled to produce a difference in plasma density in the regions from which said at least two ion beams are extracted, and in one embodiment such control can be provided by generating the electromagnetic field in the chamber using at least two differentially controllable coils arranged around said chamber.

The invention extends to methods, apparatus and/or use substantially as herein described with reference to the accompanying drawings.

Any feature in one aspect of the invention may be applied to other aspects of the invention, in any appropriate combination. In particular, method aspects may be applied to apparatus aspects, and vice versa.

Preferred features of the present invention will now be described, purely by way of example, with reference to the accompanying drawings, in which.

Figure 1:
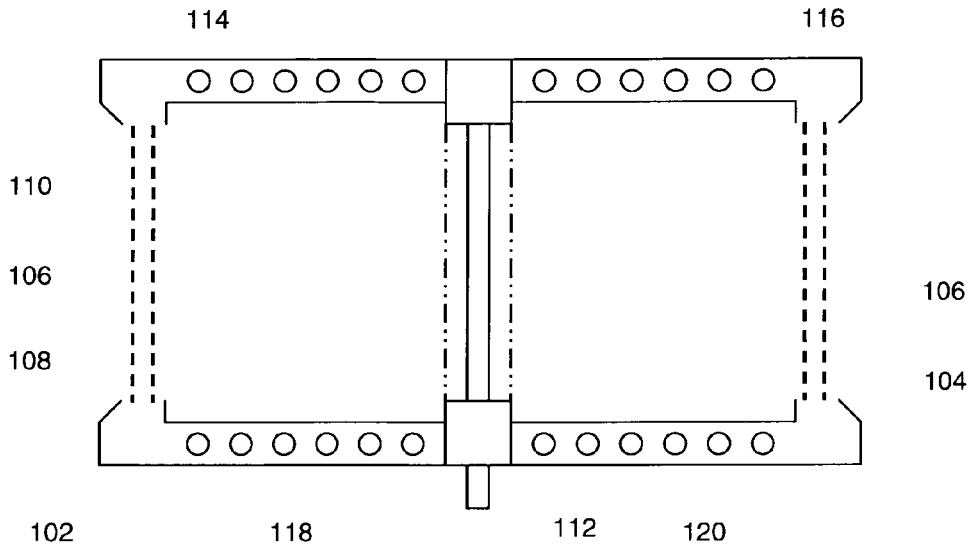
FIG. 1 shows the basic configuration of a twin ended discharge chamber employing two rf coils.

Turning to FIG. 1, the discharge chamber of an EP device comprises a ceramic body 102 defining a generally cylindrical chamber 104. At each end of the chamber is an aperture 106, through which ions are extracted from a discharge plasma in the chamber to provide a thrust. In the embodiment shown, a screen grid 108 and an acceleration grid 110 are provided at each aperture. In operation, ion extraction from the chamber can be controlled by application of varying potentials to the grids, however other embodiments may use fixed potentials.

At the centre of the chamber an annular distributor 112 allows gas flow into the chamber as part of a plasma generation process. Conducting coils 114 and 116 are provided about the chamber and driven by an rf signal to provide an electric field in the chamber which sustains the plasma generation. Coils 114 to the left of the distributor as shown are provided separately from coils 116 occupying a corresponding position on the right, and separate sets of connections are provided for each separate coil.

It is desirable in certain situations to operate using only one side of the chamber, and in such circumstances a gate can be inserted into one of the positions 118, 120. In position 118 for example, the left side of the chamber is isolated from the distributor, and coils 114 are typically not driven or left open circuit, while the device operates using the right side of the chamber and the right aperture only. Using a gate at position 120 allows the left chamber and aperture to be used in an equivalent fashion.

Figure 2:
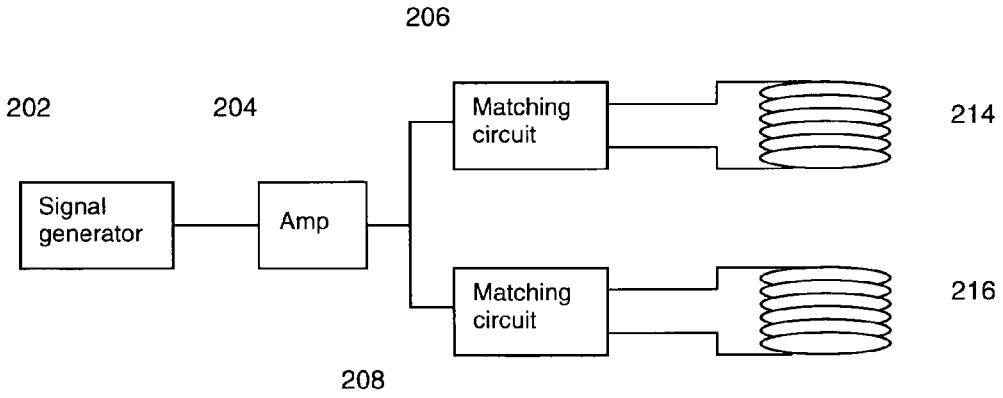
FIG. 2 shows coil drive arrangements.

The coils used in generating and sustaining the plasma in the chamber are driven as illustrated in FIG. 2. A signal generator 202 provides an oscillating radio frequency signal which is fed to amplifier 204. The output from signal generator 202 is typically of the order of a few mA, and in this example has a frequency of approximately 6.5 MHz, however a variable frequency generator may be employed. The output from the amplifier is typically adjustable up to a maximum of approximately 30 W. A t-piece separates the output from the amplifier and passes it to matching circuits (antenna tuners) 206 and 208. Each matching circuit is independently controllable and comprises an LC resonant circuit having variable values of capacitance and inductance. Coils 214 and 216 are driven by matching circuits 206 and 208 respectively. In this way power transferred to the coil(s) can be adjusted by tuning of the matching circuit to control the forward power passed to and loss experienced by each of the coils. As noted above, variation of the parameters of one matching circuit typically results in a variation in the power resulting in both coils due to coupling effects, however the difference in power experienced by the coils can still be controllably varied.

Figure 3:
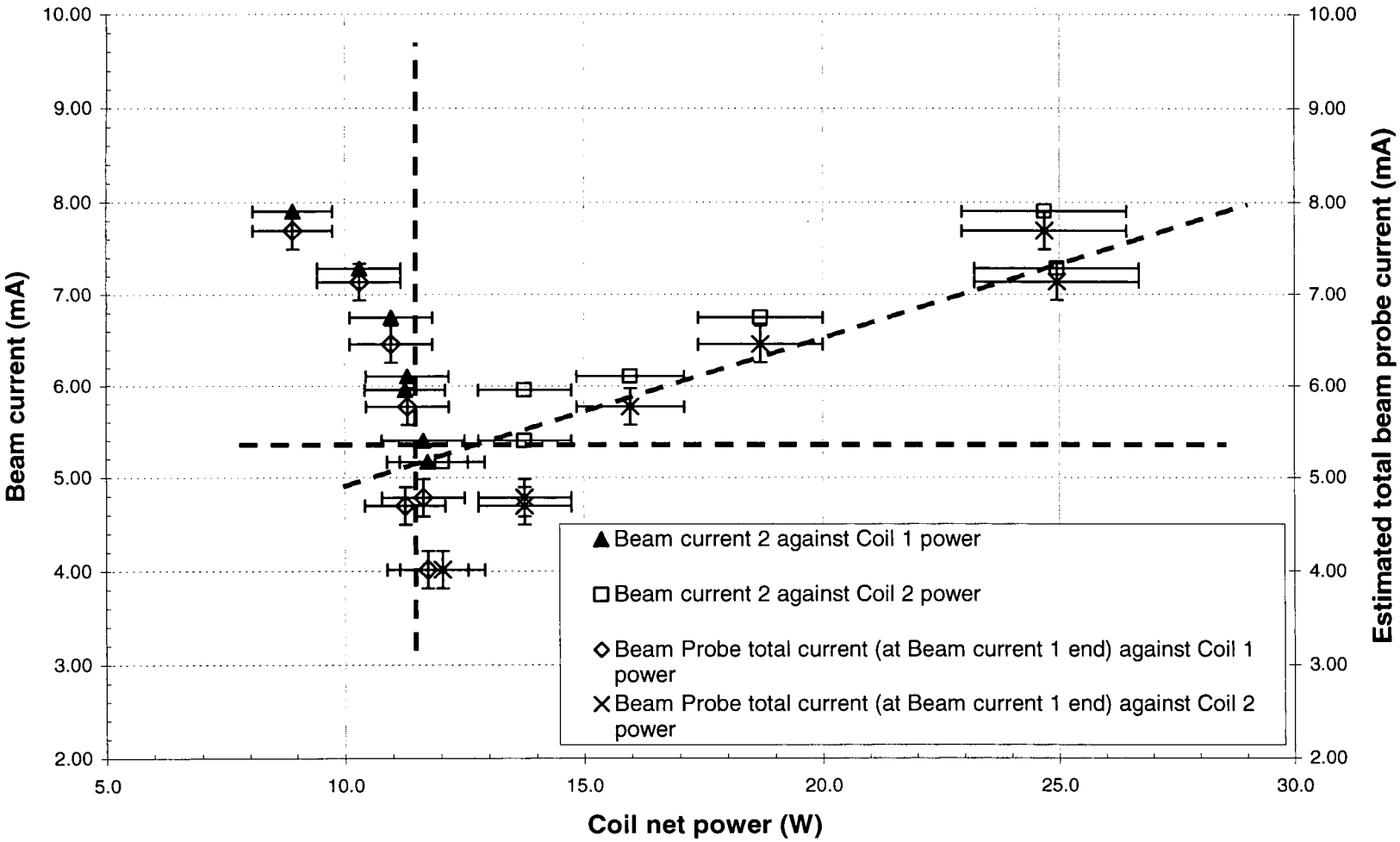
FIG. 3 is a graph illustrating beam current and probe current variation against coil net forward power.
Figure 4:
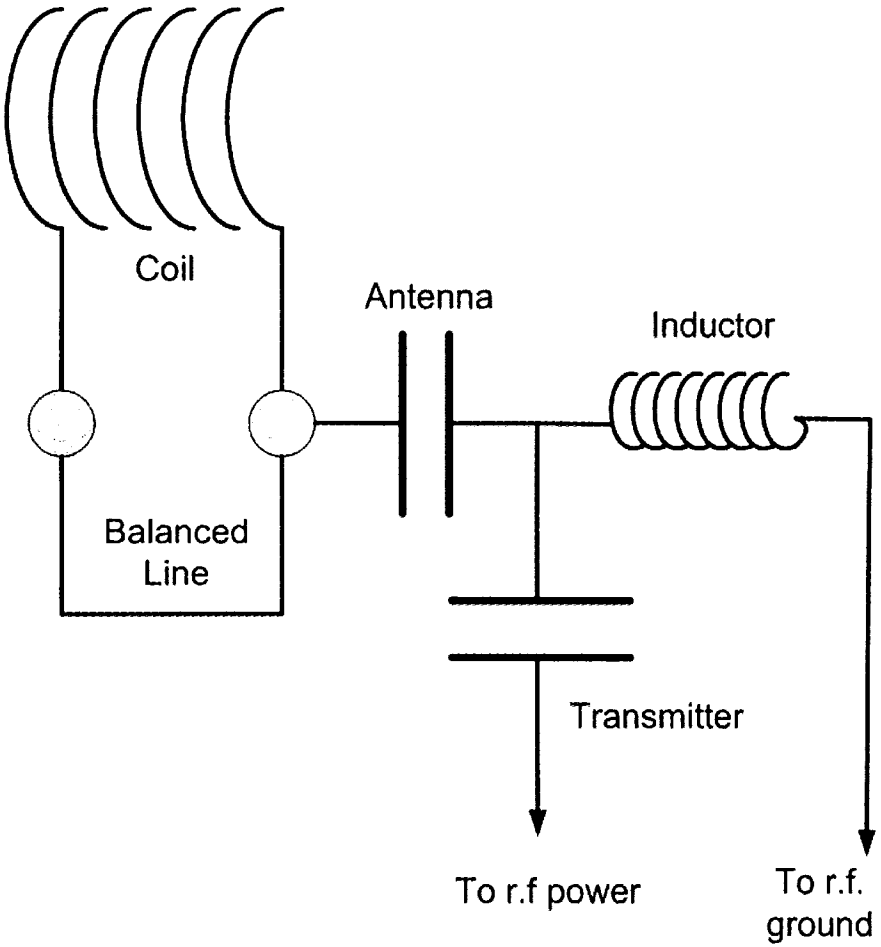
FIG. 4 is a circuit diagram of the matching circuit with components labelled with reference to the matching circuit front panel control.

With reference to FIG. 3, an EP thruster as illustrated in FIGS. 1 and 2 was operated in differential mode with a gas input flow rate of 0.050 mg/s and fixed input power of −0.7 dBm. The match on each coil circuit was varied in turn by adjusting the antenna capacitor (FIG. 4) so that more power would be transferred to the opposite coil. This produced a change in beam current. At the same time beam probes were taken from one end of the thruster.

There is a clear correlation between Coil 2 power variation and Beam 2 current (measured at the screen grid of end 2 of the device) which produces a measurable change in probe current (actual Beam 1 thrust). For the reverse case variation of Coil 1 power produces a variation in Beam 1 current but no change in the actual Beam 1 thrust, the expected thrust variation arising at Beam 2. The implication is that there is strong coupling in the system such that the coil on one side of the chamber affects the plasma on the other side.

The interaction between opposite coils and the resultant actual thrust suggests that there is a strong reflection of power by one coil power into the other which produces a level of ionisation in the opposite chamber. The associated beam current induced on the screen grid remains coupled with the input coil power and not with the reflected power and region of increased ionisation. Hence rise in beam current associated with an increasing coil power does not produce an increase in actual output beam current from this side of the chamber.

Neglecting effects of beam divergence and ion species in the extracted beam, the screen grid current, $I_B$, can be related to thrust, F, by the following relationship:

$$F = I_B\sqrt{\frac{2VA_r}{N_A e}}$$

Where $A_r$ is the relative atomic mass of Xenon (0.13129 kg), $N_A$ is Avogadro's constant ($6.022\times10^{23}$ atoms/mol), e is electron charge and V is the beam voltage.

It will be understood that the present invention has been described above purely by way of example, and modification of detail can be made within the scope of the invention. Each feature disclosed in the description, and (where appropriate) the claims and drawings may be provided independently or in any appropriate combination.

The invention claimed is:

1. An electric propulsion system comprising:

a plasma chamber for containing plasma and having first and second apertures for producing ion beams in use, each of the ion beams generating a thrust;

a first coil arranged about the chamber and adapted to produce an electromagnetic field in a first region of the chamber adjacent to said first aperture;

a second coil arranged about the chamber and adapted to produce an electromagnetic field in a second region of the chamber adjacent to said second aperture; and a radio frequency (RF) drive module adapted to produce an asymmetry in a density of the plasma in use, resulting in an asymmetry in the thrusts generated by the ion beams, by differentially controlling at least one of the following: power to the first and second coils and loss to the first and second coils.

2. A system according to claim 1, wherein said drive module is adapted to control the forward power to said first and second coils.

3. A system according to claim 1, wherein the drive module is adapted to vary the loss of said first and second coils.

4. A system according to claim 1, wherein said first and second apertures are arranged to produce ion beams in respective directions which are substantially anti-parallel.

5. A system according to claim 1, wherein said drive module is adapted to drive said first and second coils to control a net thrust generated by said propulsion system.

6. A system according to claim 1, wherein said drive module comprises a common signal generator connected to first and second matching circuits for driving said first and second coils respectively.

7. A system according to claim 1, wherein said drive module comprises independent signal generators for said first and second coils.

8. A system according to claim 1, wherein said plasma chamber comprises one or more additional apertures, a respective coil arranged around the chamber and adapted to produce an radio frequency (RF) electric field in a region of the chamber adjacent each said additional aperture, and wherein said RF drive module is adapted additionally to provide independent control to each said additional coil.

9. A system according to claim 1, wherein a screen grid and an acceleration grid are provided at one or more of said apertures, and further comprising a grid controller for controlling the electric field between the acceleration and screen grids.

10. A system according to claim 9, wherein said grid controller is adapted to maintain the potential of the screen grid and to vary the potential of the acceleration grid.

11. A method of operating an electric propulsion system comprising:

creating a discharge plasma in a plasma chamber having first and second apertures for producing ion beams in use;

extracting at least two ion beams from said plasma chamber, each ion beam generating a thrust; and producing an asymmetry in a density of the plasma resulting in an asymmetry of the thrusts generated by said ion beams, by differentially controlling power to and/or loss to:

a first coil arranged about the chamber and adapted to produce an electromagnetic field in a first region of the chamber adjacent to said first aperture; and a second coil arranged about the chamber and adapted to produce an electromagnetic field in a second region of the chamber adjacent to said second aperture.

12. A method according to claim 11, wherein the electromagnetic field in the first region of the chamber and the electromagnetic field in the second region of the chamber are controlled to produce a difference in plasma density in the regions from which said at least two ion beams are extracted.

* * * * *